United States Patent [19]

Clark

[11] 4,285,638

[45] Aug. 25, 1981

[54] JET PUMP NOZZLE ASSEMBLY

[75] Inventor: Kenneth M. Clark, Tulsa, Okla.

[73] Assignee: Dresser Industries, Inc., Dallas, Tex.

[21] Appl. No.: 55,922

[22] Filed: Jul. 6, 1979

[51] Int. Cl.[3] ..... F04F 5/46

[52] U.S. Cl. ..... 417/172; 417/195; 417/198

[58] Field of Search ..... 417/151, 167, 172, 195, 417/198, DIG. 1

[56] References Cited

U.S. PATENT DOCUMENTS

| | | | |
|---|---|---|---|
| 1,583,090 | 5/1926 | Ostermann | 417/167 |
| 2,114,905 | 4/1938 | McMahon | 417/172 |
| 2,489,636 | 11/1949 | Gurley | 417/172 |
| 2,608,801 | 9/1952 | Ridley | 417/195 |
| 2,915,987 | 12/1959 | McMahon | 417/195 |
| 3,551,074 | 12/1970 | Stout | 417/172 |
| 4,135,861 | 1/1979 | Brown et al. | 417/DIG. 1 |

*Primary Examiner*—Carlton R. Croyle
*Assistant Examiner*—Edward Look
*Attorney, Agent, or Firm*—J. N. Hazelwood; W. R. Peoples

[57] ABSTRACT

A jet pump has a nozzle assembly within a pump body to direct power fluid into a venturi assembly for mixing with well fluid to be pumped. The nozzle assembly has a nozzle shell removably mounted in the pump body and a nozzle tip mounted securely to the nozzle shell. The nozzle tip has one end portion mounted within an opening of the nozzle shell and is secured to the nozzle shell by a bonding material.

4 Claims, 5 Drawing Figures

JET PUMP NOZZLE ASSEMBLY

TECHNICAL FIELD

This invention is related to nozzle assemblies for jet pumps of the type used in wells such as oil wells.

BACKGROUND OF THE INVENTION

Because the nozzle assembly of a jet pump must handle a fluid stream moving at a relatively high velocity, the components thereof must be made of corrosion and abrasion resistant material such as ceramics and certain metal alloys. This is extremely essential when dealing with oil wells wherein the well fluid will contain a considerable quantity of solid particulate material such as sand.

In order to overcome the problem of nozzle damage due to corrosive material and moving particulate material in the nozzle assembly, it is well known in the art to make jet pump nozzles from any of several metal alloys commonly referred to as carbides. These materials when used in the jet pump nozzle perform satisfactorily in regard to resistance to corrosion and abrasion, however, these materials are extremely brittle. Because of the brittle characteristic of these materials, the jet pump body must be designed and manufactured with precision so the geometry of the pump which supports the nozzle does not apply undue force loads to the nozzle assembly which would fracture or otherwise damage the nozzle assembly. A cracked or fractured nozzle assembly can make the jet pump inoperable or create a leak path within the pump which would significantly effect operation of the pump. In addition to this, these components of the pump must be handled with care not only during the manufacturing thereof but afterwards during assembly because of their extremely brittle nature.

SUMMARY OF THE INVENTION

In an embodiment, a jet pump nozzle assembly has a nozzle shell of a solderable metal material which is constructed to be mounted within a jet pump body. The nozzle shell has an opening at an outlet end thereof in which a corrosion and abrasion resistant nozzle tip is located. The nozzle tip is secured to the nozzle shell by a bonding material acting between adjacent surfaces of the two parts.

One object of this invention is to provide a jet pump nozzle assembly which overcomes the aforementioned disadvantages of the fragile prior art devices.

Still, one other object of this invention is to provide a jet pump nozzle assembly that has a corrosion and abrasion resistant nozzle tip that is mounted within a resilient nozzle shell for use in an oil well jet pump.

Still, another object of this invention is to provide an oil well jet pump nozzle assembly that has a resilient nozzle tip supporting structure that will permit a slight deformation of this nozzle supporting structure without damage to an attached nozzle tip constructed of a very fragile material.

Various other objects, advantages and features of this invention will become apparent to those skilled in the art from the following discussion, taken in conjunction with the accompanying drawings, in which:

Figure 1:
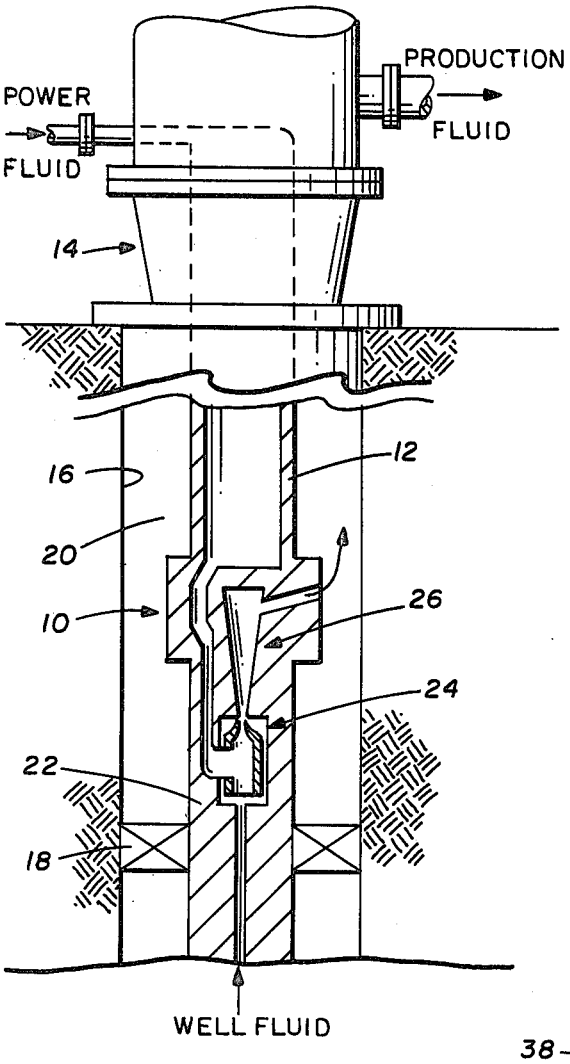
FIG. 1 is a schematically illustrated jet pump and a well with the fluids passing therethrough identified by title.

The following is a discussion and description of preferred specific embodiments of the jet pump nozzle assembly of this invention, such being made with reference to the drawings whereupon the same reference numerals are used to indicate the same or similar parts and/or structure. It is to be understood that such discussion and description is not to unduly limit the scope of the invention.

DETAILED DESCRIPTION

Referring to FIG. 1, this illustrates the general arrangement of a typical well jet pump in a producing well such as an oil well. The jet pump, indicated generally at 10, is located in the well's tubing string 12, supported from the well head 14 and located within a lower portion of the well bore 16. Below jet pump 10 a packer 18 provides a seal within the well annulus 20 between the tubing string and the interior of well bore 16. Well pump 10 includes a pump body cavity assembly 22 which removably mounts the pump body so the pump can be installed and removed without withdrawing tubing string 12 from the well. High pressure power fluid is pumped down through tubing string 12 into the jet pump nozzle assembly indicated generally at 24. Well fluid passes upward through a passage in the lower end of pump body cavity assembly 22 and is displaced by fluid flow through nozzle assembly 24 into a venturi assembly 26 whereupon it continues upward into well annulus 20 and is withdrawn through well head 14 as production fluid at ground level.

Figure 2:
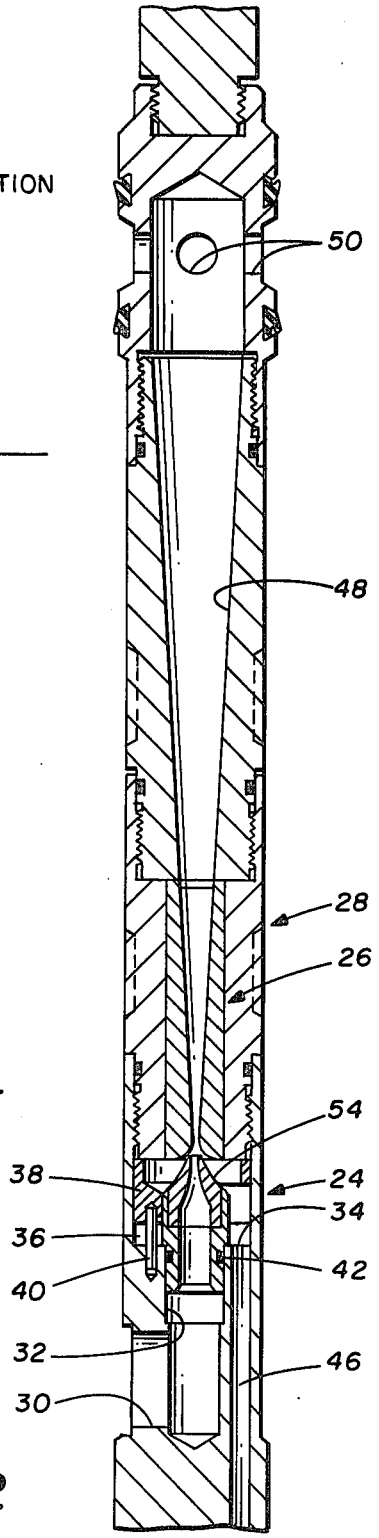
FIG. 2 is a cross-sectional elevation view of a jet pump body including the nozzle assembly, the venturi assembly and the associated ports and passageways.

FIG. 2 is an enlarged cross-sectional view of the jet pump body indicated generally at 28. In the lower portion of jet pump 28, a power fluid inlet 30 and an associated passage admit power fluid into the pump body and into a cross-sectionally circular pump body opening 32 which mounts nozzle assembly 24. In this lower portion of the pump body, a planar surface 34 is formed transverse to the longitudinal axis of the pump body that is in line with the longitudinal axis of pump body opening 32. Nozzle assembly 24 has one surface of an interrupted flange 36 resting on this planar surface 34. A nozzle assembly retainer 38 is positioned within the pump body above nozzle assembly 24 and functioning in cooperation with a locator pin 40, positions and secures the nozzle assembly in the pump body. A seal 42 is mounted in a groove 44 around the outer periphery of the nozzle to provide a fluid tight seal between the nozzle assembly and opening 32 in the pump body. Venturi assembly 26 is positioned above or downstream of nozzle assembly 24. Well fluid arrives at the entrance of venturi assembly 26 by internal passage 46 through the pump body. The venturi assembly which is well known in the art mixes the power fluid with the well fluid and displaces both of these upward through the shaped venturi interior 48 to outlets 50 at the upper end portion of the pump body. Pumped fluid passing through outlets 50 travels through additional openings and passages within pump body cavity assembly 22 before it is discharged into well annulus 20 and from there passes onto the well head 14.

Figure 3:
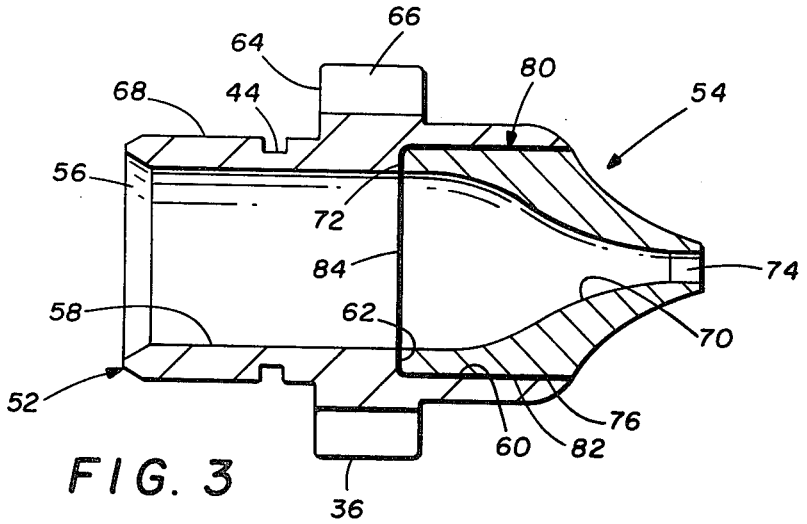
FIG. 3 is an enlarged cross-sectional view of the nozzle shell and the nozzle tip joined together from the pump shown in FIG. 2.
Figure 4:
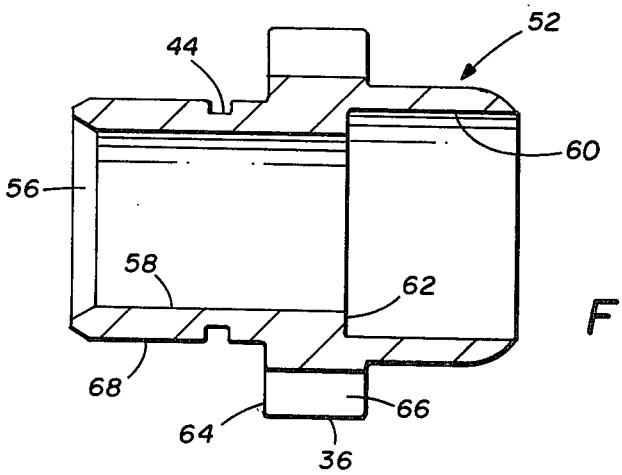
FIG. 4 is an enlarged cross-sectional view of the nozzle shell alone.
Figure 5:
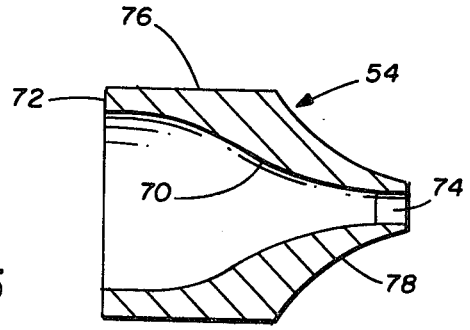
FIG. 5 is a cross-sectional elevation view of the nozzle tip alone.

FIGS. 3–5 show in detail the improved jet pump nozzle assembly of this invention. The nozzle assembly includes a nozzle shell indicated generally at 52 and a nozzle tip indicated generally at 54. Nozzle shell 52 is an elongated hollow member with one end portion designed to mount within pump body opening 32 and the other end portion adapted to receive and mount nozzle tip 54. Nozzle shell 52 has an inlet 56 on the end which is adapted to be mounted within the jet pump body and a cross-sectionally circular longitudinally disposed internal passage 58 communicating from inlet 56 through a major portion of the nozzle shell. At the opposite end of the nozzle shell, an enlarged opening having a cross-sectionally circular longitudinally disposed interior wall 60 and a transversely disposed abutment 62 form a receptacle to receive and position nozzle tip 54. Abutment 62 extends transverse relative to the longitudinal axis of internal passage 58. Around the exterior of nozzle shell 52 the interrupted flange 36 is provided. Flange 36 has a planar surface 64 on the side which is closest to inlet 56 and which mounts upon planar surface 34 in the jet pump body 28 when the nozzle assembly is installed. Flange 36 also has a plurality of recesses 66 in a spaced relation around the outer periphery thereof to provide a passage for locator pin 40 and other passages for the well fluid and thereby form a portion of well fluid passage 46. FIG. 2 shows one such locator pin and one of the fluid passages. When nozzle assembly 24 is mounted in jet pump body 28, surface 64 rests in flush contact with jet pump body planar surface 34 and nozzle assembly retainer 38 secures nozzle shell 52 in the position shown in FIG. 2. The exterior of nozzle shell 52 has a cylindrical exterior surface 68 extending from flange surface 64 to the end of the shell having inlet 56. Groove 44 is formed as a recess around shell exterior surface 68.

Nozzle tip 54 is shown alone in FIG. 5 and mounted with nozzle shell 52 in FIG. 3. Nozzle tip 54 is an elongated hollow member having a shaped internal opening 70 communicating from an inlet at a lower end 72 to a reduced size outlet 74 at the opposite or upper end thereof. Reference to upper and lower is made considering the nozzle assembly placed in the pump and located in its operating position in a well as shown in FIGS. 1 and 2. The exterior of nozzle tip 54 includes a cylindrical exterior segment 76 extending from lower end 72 to approximately a mid-portion of the tip where it joins a curved and shaped surface 78 that tapers to a reduced size at the outlet 74. Tip end 72 is transverse to the longitudinal axis of the tip cylindrical exterior 76. Tip end 72 is positioned at abutment 62 within nozzle shell 58 when tip 54 is installed.

Nozzle shell 52 is constructed of a steel or alloy metal material which is somewhat resilient in nature and will permit slight deformations of the tubular walls thereof and of flange 36 when it is mounted in jet pump body 28 and secured in place by retainer 38. Nozzle tip 54 is constructed of a corrosion and abrasion resistant material in order that it will have a substantial useful life without degradation of interior and exterior surfaces 70 and 78 while operating in the hostile environment of an oil well or the like where it may be subjected to relatively high velocity fluid flow that may contain abrasive particulate material such as sand. Tip 54 is preferably constructed of such a material having the aforementioned characteristics and being of a weldable or solderable metal alloy or other material which is capable of being soldered or bonded to nozzle shell 52. In practice, nozzle tip 54 has been constructed of a composition of the metal alloy generally referred to as carbide. While carbide has very good corrosion and abrasion resistant characteristics, it is also relatively brittle. Because of the brittle nature of this carbide material, tip 54 is insulated from possibly damaging forces occasioned by the mounting or nozzle sheel 52 by a zone of bonding or connecting material indicated generally at 80. This bonding material 80 is formed in a cylindrical segment 82 positioned between the interior nozzle sheel surface 60 and the exterior cylindrical nozzle tip surface 76 and in another segment 84 between nozzle shell abutment 62 and nozzle tip end 72.

Bonding material 80 can be a non-metallic material possessing sufficient strength and wear resistance to join nozzle shell 52 and nozzle tip 54 in the hostile environment of an oil well or it can be a metal material. An example of such metal material is any of several low melting point metal alloys commonly referred to as solder which are compositions having the basic constituents of tin and lead, brass and lead, tin and silver or brass and silver. These solders have a melting point which is significantly below that of nozzle shell 52 and nozzle tip 54 so the solder material can be heated in conjunction with a corresponding flux and applied to the nozzle assembly thereby flowing between the elements thereof in an interposed relation and joining the elements upon cooling. Bonding material 80 forms a fluid tight seal between nozzle shell 52 and nozzle tip 54 and additionally provides a resilient zone of material connecting these two elements of the nozzle assembly to effectively and operably isolate nozzle tip 54 from deformation of nozzle shell 52 which is substantial enough to otherwise fracture or damage nozzle tip 54.

In assembling nozzle assembly 24, nozzle shell 52 and nozzle tip 54 are preheatted to encourage movement of the bonding material or solder through the small space between these pieces. When these pieces are sufficiently heated, nozzle tip 54 is placed within the enlarged opening of nozzle shell 52. Next the soldering flux and the solder material are applied at the joint of the separate pieces on the exterior of the nozzle assembly. Heating of the nozzle shell and the nozzle tip continues for a short period of time after placement of the solder and the flux in order to insure movement of the solder between these pieces. Once the soldering is completed, the nozzle assembly 24 is set aside to cool and thereafter cleaned and installed in the jet pump body 28.

The embodiments of the invention in which an exclusive property or privilege is claimed are defined as follows:

1. An improved jet pump, comprising:

a pump body having a longitudinal passage means therein to receive fluid to be pumped;

a venturi assembly mounted within said pump body including a venturi body placed in a pump fluid flow path to receive in the inlet thereof fluid to be pumped and power fluid, said venturi assembly being operably connected in fluid communication with an outlet from said pump body; and a nozzle assembly within the pump body including a nozzle shell mounting means in said pump body, a hollow nozzle shell having one end portion mounted in said shell mounting means and having an outlet opening positioned near the inlet of said venturi body, and a tubular nozzle tip mounted within said nozzle shell outlet opening and extending therefrom, said nozzle tip being secured to said nozzle shell by a bonding material interposed between said nozzle tip and said nozzle shell, said nozzle mounting means including an opening in said pump body to receive and mount one end of said nozzle shell and an abutting surface around an end of said mounting means to support a surface of said nozzle shell; and said nozzle nozzle-and shell having a tubular end portion mounted in said nozzle shell mounting means opening and an outwardly extending flange having said surface on one side thereof in contact with said mounting means abutting surface;

(a) said nozzle tip being constructed of a corrosion and abrasion resistant solderable material that has a brittle nature;

(b) said nozzle shell being constructed of a solderable metal material that has a resilient nature; and (c) said bonding material having a resilient nature and joining both said nozzle shell and said nozzle tip in order to form a fluid tight seal therebetween and to compensate for deformation of said nozzle shell when it is mounted in a nozzle housing thereby preventing possible damage to said nozzle tip by isolating said nozzle tip from deformation of said nozzle shell that may occur upon mounting of said nozzle shell within a pump housing.

2. The improved jet pump of claim 1, wherein said bonding material is a metal material solderably joinable to said nozzle tip and said nozzle shell.

3. The improved jet pump of claim 2, wherein said bonding material has a melting point substantially less than the melting point of said nozzle tip and said nozzle shell.

4. The improved jet pump of claim 3, wherein said bonding material is selected from the group of tin-lead base solders, brass-lead base solders, tin-silver base solders and brass-silver base solders.

* * * * *